United States Patent [19]

Ament

[11] 4,351,283

[45] Sep. 28, 1982

[54] DIESEL FUEL INJECTION PUMP SECONDARY FUEL METERING CONTROL SYSTEM

[75] Inventor: Frank Ament, Rochester, Mich.

[73] Assignee: General Motors Corporation, Detroit, Mich.

[21] Appl. No.: 259,589

[22] Filed: May 1, 1981

[51] Int. Cl.[3] ..... F02M 39/00

[52] U.S. Cl. ..... 123/458; 123/459; 123/460; 123/506

[58] Field of Search ..... 123/458, 459, 460, 506, 123/450; 417/462

[56] References Cited

U.S. PATENT DOCUMENTS

| | | | |
|---|---|---|---|
| 3,598,507 | 8/1971 | Voit et al. | 123/450 |
| 3,861,833 | 1/1975 | Salzgeber et al. | 417/254 |
| 3,880,131 | 4/1975 | Twaddell et al. | 123/500 |
| 4,206,735 | 6/1980 | Miles et al. | 123/458 |

*Primary Examiner*—Ira S. Lazarus
*Assistant Examiner*—Magdalen Moy
*Attorney, Agent, or Firm*—Arthur N. Krein

[57] ABSTRACT

A secondary fuel metering control system for a normally solenoid valve controlled spill-inject-spill type engine driven fuel injection pump includes an isolation valve to control spill flow from the pump chamber of the pump back to the fuel reservoir, a pivotal metering valve operative to meter fuel flow to the pump chamber, and an actuator means including an operator actuated accelerator means and an electrical actuator for controlling pivotal movement of the metering valve.

3 Claims, 15 Drawing Figures

SOLENOID MODE
ALL CONDITIONS
SPILL OPEN

SECONDARY MODE
CRANKING
SPILL BLOCKED

IDLE SPILL
MODULATED

NORMAL DRIVING
SPILL BLOCKED

MAX RPM
SPILL OPEN

DIESEL FUEL INJECTION PUMP SECONDARY FUEL METERING CONTROL SYSTEM

FIELD OF THE INVENTION

This invention relates to diesel fuel injection pumps and, in particular, to a secondary fuel metering control system for such a pump of the type having a primary fuel metering control arrangement that is operated by at least one solenoid valve actuated in response to engine operating conditions.

DESCRIPTION OF THE PRIOR ART

A conventional fuel injection pump, of the type disclosed, for example, in U.S. Pat. No. 3,861,833 entitled "Fuel Injection Pump" issued Jan. 21, 1975 to Daniel Salzgerber, Robert Raufeisen and Charles W. Davis, is adapted to deliver metered charges of fuel under high pressure sequentially, by means of a rotary distributor, to the cylinders of an associated engine in timed relationship therewith. In a pump of the above-identified type, a cam ring having inwardly directed cam lobes surrounds one or more pump plungers that are movable relative thereto whereby to translate the contour of the cam lobes into a sequence of pumping strokes producing the high pressure charges of fuel to be delivered to the engine.

In the above-identified type pump, the fuel quantity is mechanically controlled by inlet metering. Normally, a timing advance mechanism is used to adjust the angular position of the cam ring whereby to regulate the timing of injection into the cylinders of the engine as a function of engine speed. A mechanical (flyweight) governor is normally used to control the fuel quantity as a function of pump speed.

As an alternate to the above-described mechanical fuel metering and timing control system, it has been proposed to electronically control the fuel injection in such a fuel injection pump. As disclosed, for example, in U.S. Pat. Nos. 3,598,507, entitled "Fuel Injection Pump for Multicylinder Internal Combustion Engines", issued Aug. 10, 1971 to Willi Voit and 3,880,131, entitled "Fuel Injection System for an Internal Combustion Engine", issued Apr. 29, 1975 to Russell W. Twaddell and Edwin B. Watson, the quantity and timing of the fuel to be injected is controlled by means of one or more solenoid valves.

In a pump structure of the type disclosed in the above-identified U.S. Pat. No. 3,880,131 patent, the pump plungers are normally supplied with an excess quantity of fuel, with the pressurized fuel delivered during a pump stroke of the plungers then flowing either to an injection nozzle or to a spill passage as controlled by at least one solenoid valve that is electrically actuated, as by a conventional electronic computer, as a function of engine operation whereby to control fuel metering and injection timing. This type pump with solenoid valve controlled fuel injection may be referred to as an electronic controlled spill-inject-spill pump. This term "spill-inject-spill" is deemed appropriate due to the fact that the solenoid valve or valves are of the normally open type and thus, when the associate solenoid valve is deenergized, and therefore in its open position, pressurized fuel will flow through the valve to a spill passage for return to the fuel tank for the engine. Injection of fuel will then occur when the associate solenoid valve is energized to its closed position whereby the spill path is closed so that the pressurized fuel will then flow to the associate, in register, fuel injection nozzle. Then when the solenoid valve is again deenergized, injection is terminated and spill flow will again occur until the pump stroke of the plungers is terminated. Alternately, if desired, spill flow can flow to the inlet side of the associate supply pump used to supply fuel to the pump chambers.

It will thus be apparent that, with the above type operational arrangement, if a malfunction occurs whereby a solenoid valve cannot be pulsed to its closed position so as to block flow through the spill path, all of the fuel discharged by the pump plungers will be spilled and none of this fuel will be injected into the cylinders of an associated engine. Accordingly, the desirability of having a secondary fuel metering system in such an electronic controlled spill-inject-spill has been recognized.

SUMMARY OF THE INVENTION

The present invention relates to a secondary fuel metering system for a fuel injection pump of the type having a solenoid valve controlled primary fuel metering system, the secondary fuel metering system including an isolation valve and a metering valve controlled by an actuator means to meter fuel flow only when the solenoid valve of the primary fuel metering system is functionally inoperative.

It is therefore a primary object of this invention to provide a secondary fuel metering system for a solenoid spill-inject-spill type engine driven fuel injection pump whereby a metering valve and an isolation valve are operative, when required, to control fuel injection and to seal a normally open fuel spill flow path in the pump.

Another object of this invention is to provide an improved fuel metering system for an engine driven fuel injection pump wherein the system includes a primary fuel metering system having at least one solenoid valve and, a secondary metering system which automatically becomes operative upon functional failure of the primary metering system.

Still another object of the present invention is to provide a secondary fuel metering control system of the above type for a spill-inject-spill type fuel injection pump which system includes features of construction, operation and arrangement, rendering it easy and inexpensive to manufacture, which is reliable in operation, and in other respects is suitable for use on production fuel injection pump systems.

For a better understanding of the invention as well as other objects and further features thereof, reference is had to the following detailed description of the invention to be read in connection with the accompanying drawing.

DESCRIPTION OF THE PREFERRED EMBODIMENT

Figure 1:
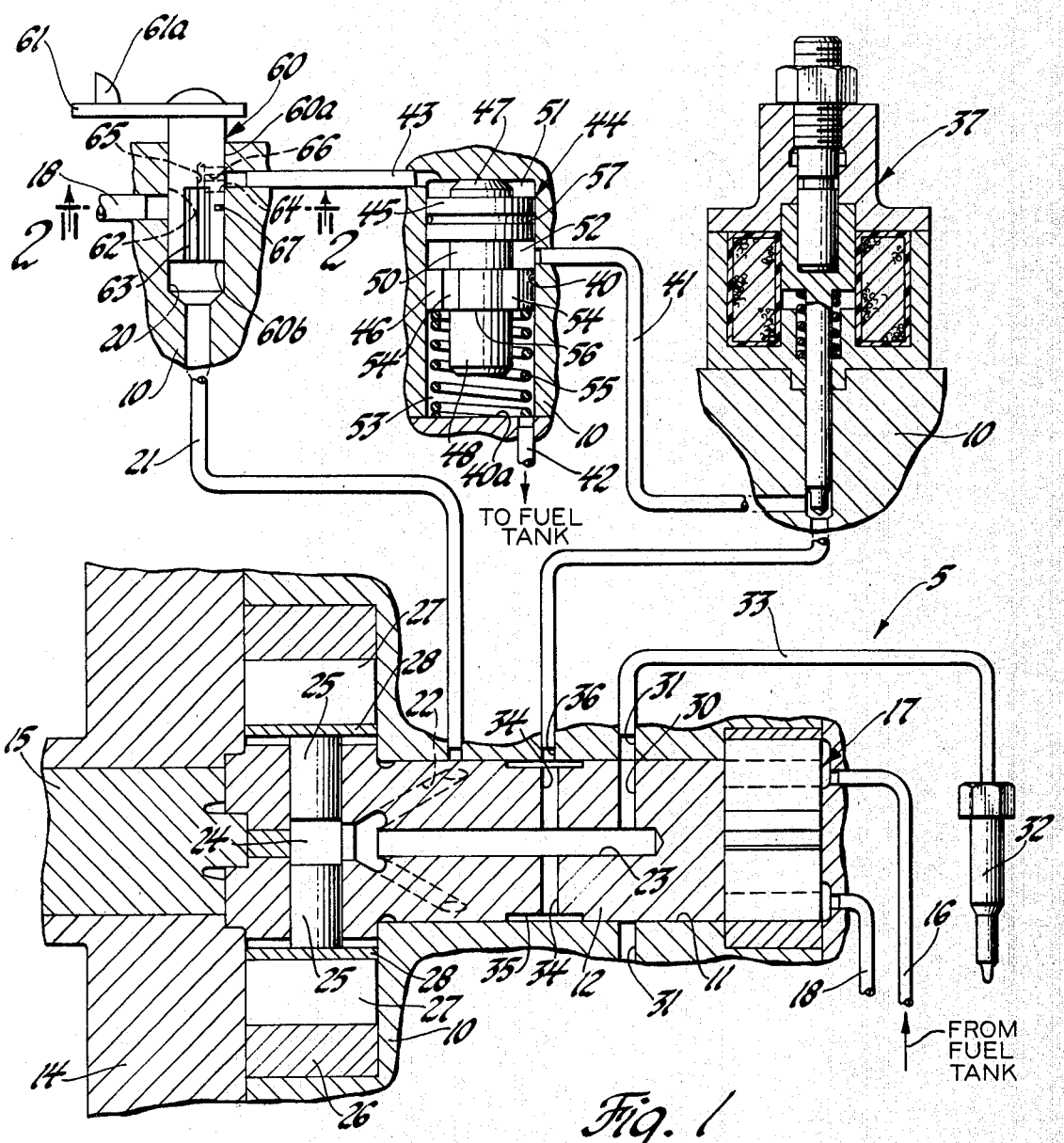
FIG. 1 is a schematic longitudinal cross-sectional view of a spill-inject-spill type engine driven fuel injection pump with a secondary fuel metering control system in accordance with one embodiment of the invention incorporated therein, with the components thereof shown in the "Solenoid Mode" of operation.

As schematically shown in FIG. 1, a first embodiment of the subject secondary fuel metering control system is incorporated into an exemplary engine driven fuel injection pump 5 of a type similar to that shown in the above-identified U.S. Pat. No. 3,861,833 that is operative to deliver pressurize fuel sequentially to a plurality of injectors associated with the cylinders of an engine, both not shown.

The pump 5 includes a hydraulic head 10 with a cylindrical stepped bore 11 therein in which a distributor rotor 12 is rotatably mounted. Hydraulic head 10 is suitably secured to a drive housing 14 by conventional means, not shown. The drive housing 14 includes a conventional mounting flange, not shown, for attaching the pump to an engine, not shown, whereby the pump drive shaft 15, which is journaled in drive housing 14 and operatively connected to one end of the distributor rotor 12, is driven by the engine in unison therewith.

Fuel from a supply fuel tank, not shown, is delivered via a conduit 16 to the inlet of an engine drive transfer pump. such as the vane-type pump 17 operatively associated with the opposite end of distributor rotor 12. With this arrangement, fuel at a predetermined transfer pressure, as a function of engine speed, is delivered from the outlet of the engine driven transfer pump 17 via a passage 18 to a chamber, identified as a metering valve chamber 20, for a purpose to be described in detail hereinafter.

Normally, a spring biased pressure regulating valve, not shown, is operatively associated with the passage 18 to control the output from the transfer pump 17 to a predetermined maximum value. From the metering valve chamber 20, the fuel is delivered by a passage 21 which is suitably connected, in a known manner, by radial ports 22 in distributor rotor 12 to the axial rotor passage 23 therein, whereby to supply fuel to the pump chamber 24 of the high pressure injection pump portion of the pump unit.

As shown, the high pressure injection pump includes a pair of opposed reciprocating plungers 25, the movements of which are controlled by circumferentially spaced apart, inwardly directed, cam lobes of a cam ring 26. Cam ring 26 is mounted in the circular enlarged diameter portion of bore 11 in the hydraulic head 10.

As is well known, in this type pump, the rotor passage 23 sequentially registers via the radial ports 22 with the passage 21 as the distributor rotor 12 rotates when the pump plungers 25 are free to move radially outward whereby the pump chamber 24 can be applied with a charge of fuel. Continued rotation of the distributor rotor 12 interrupts the communication between the radial ports 22 and the passage 21 and, then, when the cam follower rollers 27 engage the rise of the cam lobes on cam ring 26 they act through the rotor shoes 28 to force the pump plungers 25 inwardly so as to pressurize the fuel contained in the pump chamber 24 to a high injection pressure.

The thus pressurized fuel in the pump chamber 24 is then delivered by the rotor passage 23 and radial passage 30 to one of a series of passages 31, only two of which are shown in FIG. 1. The inlet port portions of the passages 31 are suitably positioned in circumferentially spaced apart relationship to each other in the hydraulic head 10 around the distributor rotor 12 for sequential registry with the passage 30, in a known manner, so as to effect the delivery of a charge of fuel from the pump chamber 24 sequentially via conduits 33 to the injection nozzles 32, only one of each being shown. Each injection nozzle is suitably positioned in a known manner so as to discharge fuel into the associated cylinders of an engine, not shown.

In such a spill-inject-spill pump, the rotor passage 23 is also in flow communication, for example, via radial passages 34 and an annular groove 35 with a spill passage 36. Flow through this spill passage 36 is controlled by at least one conventional, normally open, solenoid valve 37. As is well known, in the prior art spill-inject-spill type pumps, the spill passage 36 is adapted by suitable conduit means for flow communication with the fuel tank for the engine, both not shown.

The structure thus far described constitutes a solenoid spill-inject-spill type fuel injection pump of the type disclosed in more detail in the above-identified U.S. Pat. No. 3,880,131 with the basic pump structure, per se, being of the type disclosed in greater detail in the above-identified U.S. Pat. No. 3,861,833, the disclosures of which are incporated herein by reference thereto.

As is well known, the solenoid valve 37 in this type pump is adapted to be connected by electrical leads, not shown, to an electronic computer, such as an electronic on-board computer, not shown, whereby the solenoid can be actuated as a function of engine operation whereby it is operative to control fuel metering and injection timing. Thus in the construction illustrated, this solenoid valve fuel control arrangement is referred to herein as the primary fuel metering control system of the fuel injection pump shown.

Figure 2:
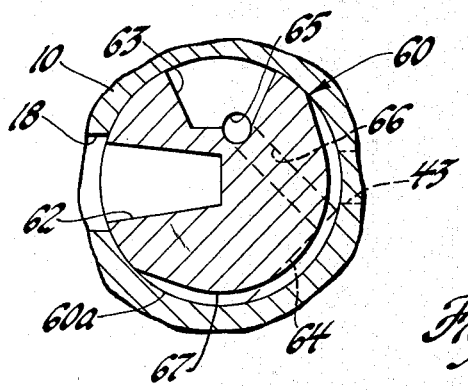
FIG. 2 is a sectional view of the metering valve and the associate portion of the pump housing of the pump of FIG. 1 taken along line 2—2 of FIG. 1 with the metering valve in the "Solenoid Mode" position.
Figure 3:
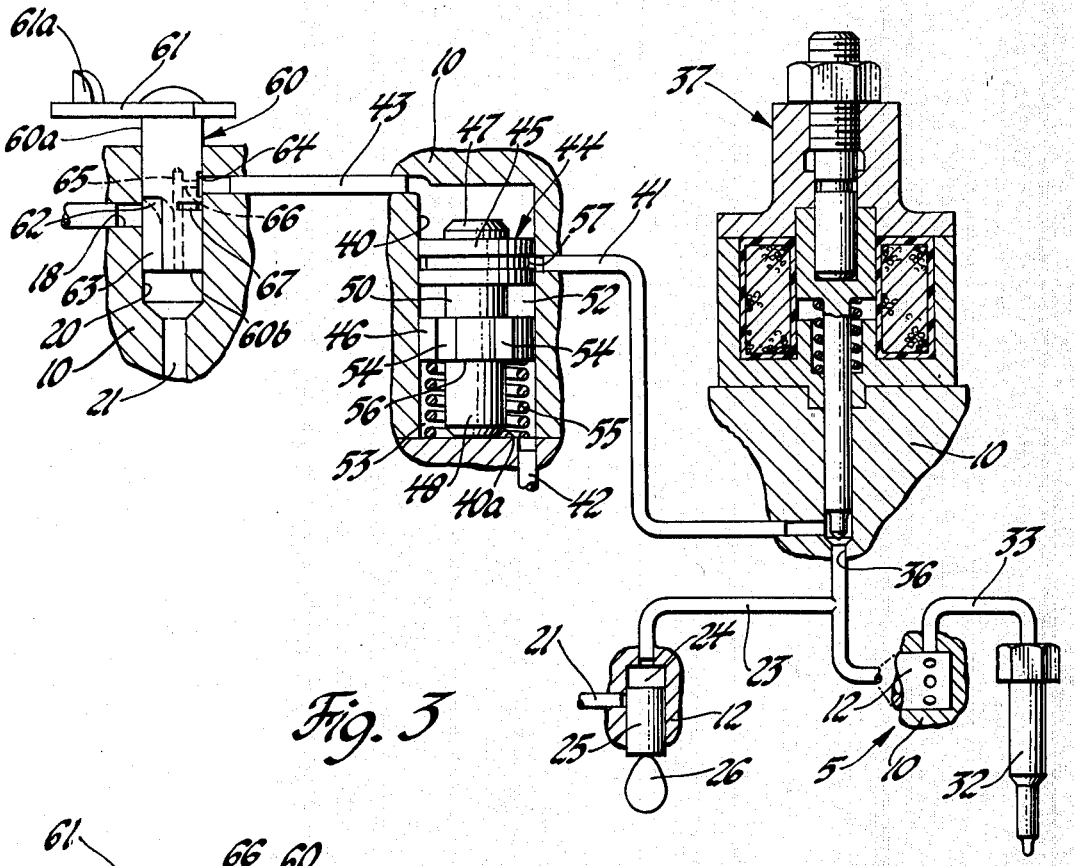
FIG. 3 is a schematic cross-sectional view of the pump structure of FIG. 1 but with the metering valve and isolation valve thereof positioned in the "Secondary Mode" of operation.

Now in accordance with the invention, the fuel injection pump 5 has a secondary fuel metering control system incorporated therein. For this purpose the hydraulic head 10, preferably a multiple piece element in the embodiment shown in FIGS. 1, 2 and 3, is provided with a drain passage means that includes an enclosed cylinder 40 which intermediate its ends is interconnected by a spill passage 41 to the spill passage 36 downstream of solenoid valve 37, in terms of the direction of spill fuel flow through spill passage 36. Cylinder 40 at its lower end, with reference to FIG. 1, is in communication via a drain passage 42 with a source of low pressure fuel, as for example, by being connected in a suitable manner to the fuel tank for the engine, both not shown. At its opposite or upper end, the cylinder 40 is connected by means of a control passage 43 with the metering valve chamber 20 intermediate the ends thereof.

As shown, an isolation valve 44 is slidably received in the cylinder 40. The isolation valve 44, in the embodiment illustrated in FIGS. 1 and 3, is a landed valve having axial spaced apart upper and lower lands 45 and 46, respectively, that are slidably received by the internal circular wall defining the cylinder 40 in the hydraulic head 10. Isolation valve 44 is also provided at opposite ends with reduced diameter upper and lower portions 47 and 48, respectively, and intermediate its lands 45 and 46 with a reduced diameter portion 50.

The reduced diameter portions 47, 50 and 48 thus define with the circular wall defining cylinder 40, a variable volume pressure chamber 51, a spill chamber 52 and a variable volume drain chamber 53, respectively. As shown, spill chamber 52 is in direct flow communication with drain chamber 53 as, for example, by means of a plurality of axial extending slots 54 provided in the land 46 portion the isolation valve. As shown, the pressure chamber 51 is in flow communication with control passage 43 while drain chamber 53 is in flow communication with drain passage 42.

As shown in FIGS. 1 and 3, the isolation valve 44 is adapted for movement between a first position at which spill passage 41 is in flow communication with spill chamber 52, the position shown in FIG. 1, and a second position at which the upper land 45 blocks flow from the spill passage 41, the position shown in FIG. 3. The first and second positions of the isolation valve 44 occur during the "Solenoid Mode" and "Secondary Mode" of pump operation in a manner to be described in detail hereinafter.

Isolation valve 44 is normally biased to the first position shown in FIG. 1 by means of a coil spring 55 positioned in the drain chamber 53 with one end thereof in abutment against the lower wall 40*a* of cylinder 40 and its opposite end in abutment against the radial flat shoulder 56 of the isolation valve 44. As shown, spring 55 is of a suitable internal diameter whereby the coils thereof loosely encircle the lower portion 48 of the isolation valve.

Preferably as shown, the upper land 45 of the isolation valve 44 is provided with an annular relief groove 57 intermediate its ends.

Normally in a conventional spill-inject-spill type fuel injection pump a conventional metering valve is not required to be operatively positioned in the metering valve chamber 20. However, in accordance with a feature of the subject invention, a metering valve 60 is operatively positioned in the metering valve chamber 20 and it has a lever 61 suitably fixed thereto. Lever 61 is adapted to be actuated by a suitable actuator means, to be described in detail hereinafter, whereby the metering valve 60 can be rotated to selectively control flow through the passage 18, and from the passage 18 to passage 21 or to both passage 21 and control passage 43. For this purpose, lever 61 is provided with an upstanding cam 61*a*, of suitable configuration, that is spaced radially outward from the rotative axis of the metering valve 60 for a purpose to be described in detail hereinafter.

In accordance with a feature of the invention, the outer circular land portion 60*a* of metering valve 60 is provided with a straight longitudinal groove 62 of predetermined width and depth that extends axially from a position above the opening of passage 18 into metering valve chamber 20 downward to break out through the lower surface 60*b* of the metering valve 60. In addition metering valve 60 is provided with a metering groove 63, a conventional metering groove of predetermined width and depth, that extends longitudinally in a manner similar to groove 62 but which is circumferentially spaced apart from groove 62. In the embodiment shown, the center of the metering groove 63 is spaced 90° relative to the center of groove 62. As best seen in FIG. 2, metering valve 60 is also provided on its exterior with a circumferential extending metering slot 64 that is axially located on the metering valve for flow alignment with control passage 43, an axial passage 65 and radial passage 66 effecting flow communication between the groove 63 and metering slot 64. As best seen in FIG. 2, the metering slot 64 is located relative to metering groove 63 so that when the metering valve is rotated to a position at which the metering groove 63 is in flow communication with passage 18, the metering slot 64 will be in flow communication with control passage 43. Preferably, in addition, metering valve 60 has a circumferentially extending pressure relief groove 67 suitably axially located opposite grooves 62 and 63 for pressure balance of the metering valve 60 when its angular position is such that it blocks flow from passage 18.

A suitable actuator means, to be described in detail hereinafter, is operatively connected to the lever 61 and is operative so as to effect pivotal movement of the metering valve 60, in the manner to be described, during the following modes of operation:

Ignition Off

When the ignition system for the engine, not shown, is off, the metering valve 60 is angularly positioned so that the land 60*a* thereof covers the opening of passage 18 into metering valve chamber 20.

Solenoid Mode

During engine operation and when the solenoid valve 37 is functionally operative, the metering valve 60 is rotated to the position shown in FIGS. 1 and 2, a position at which groove 62 is in flow communication with passage 18 whereby to supply fuel directly to the passage 21 used to supply fuel to pump chamber 24 in the manner previously described hereinabove. With groove 62 thus positioned and by proper sizing of this groove 62 there will be unrestricted flow of fuel at a suitable transfer pressure through this groove. Thus the groove 62 does not function as a metering groove of the metering valve 60.

Secondary Mode

When the solenoid valve 37 is functionally inoperative, the metering valve 60 is then rotated to a position at which the metering groove 63, or a portion thereof, is in flow registration with the passage 18 whereby to then effect metering of the quantity of fuel being supplied to the pump chamber 24 in a known manner. At the same time, the metering slot 64 will come into flow registration with the control passage 43. As this occurs, supply fuel from passage 18 at transfer pressure then flows via metering groove 63, passages 65 and 66, metering slot 64 and control passage 43 into the pressure chamber 51. This pressurized fuel flowing into pressure chamber 51 is then operative to effect movement of the isolation valve 44, downward against the bias of spring 55 to the position shown in FIG. 3, whereby to block flow outward from spill passage 41, thus terminating the spill of fuel past the normally open solenoid valve 37.

Figure 4:
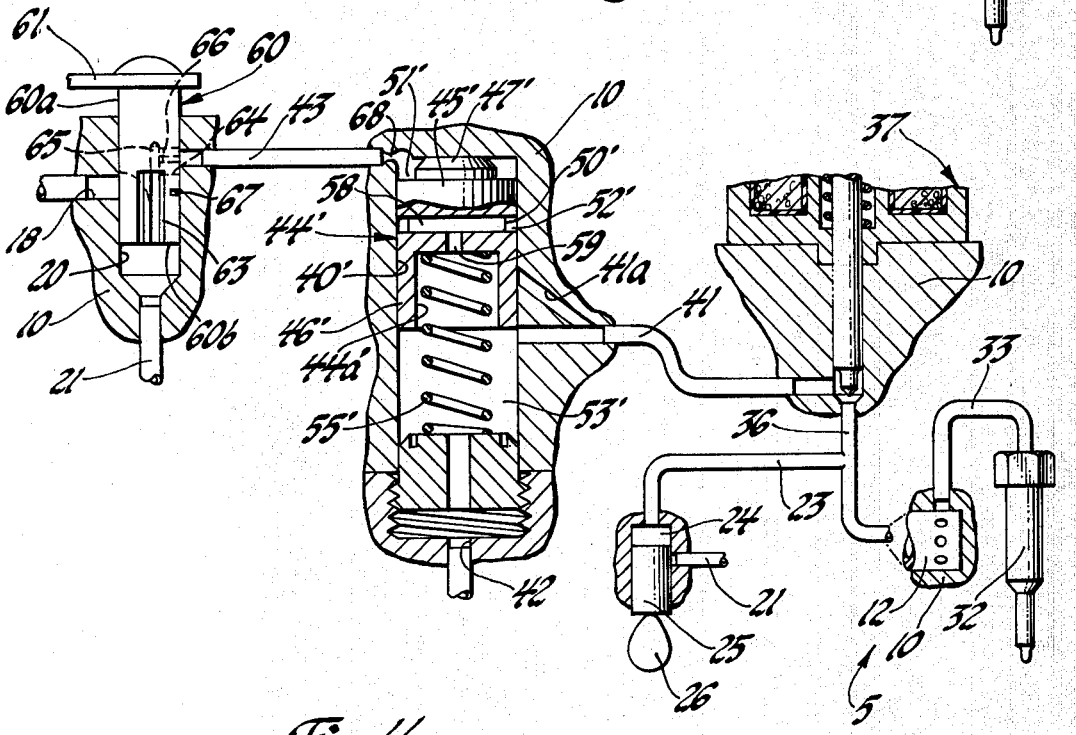
FIG. 4 is a schematic cross-sectional view of a spill-inject-spill type engine driven fuel injection pump with a seconary fuel metering control system in accordance with a preferred embodiment of the invention incorporated therein with the components thereof in the "Solenoid Mode" of operation.

A preferred alternate embodiment of a secondary fuel metering control system, in accordance with the invention, incorporated into a spill-inject-spill type fuel injection pump is shown in FIGS. 4 and 5A–5E, inclusive, wherein similar parts are designated by similar numerals but with the addition of a prime (') after the reference numeral where appropriate. The spill-inject-spill fuel injection pump 5 shown in FIG. 4 is similar to that described with reference to FIGS. 1, 2 and 3.

To maintain a stable engine speed during secondary fuel metering during idle, that is, to maintain idle speed governing, a governor arrangement is incorporated into the isolation valve 44' of the secondary fuel metering system and a spill orifice passage **41*a*** is operatively associated with the isolation valve in this preferred embodiment.

Thus as schematically illustrated in FIGS. 4 and 5A–5E, a spill orifice passage **41*a* is provided in the hydraulic head 10 of pump 5, with this spill orifice passage 41*a* located so that one end thereof is in flow communication with the spill passage 41 intermediate its ends, while the opposite end of this spill orifice passage 41*a* is located so as to open into the isolation cylinder 40 at a predetermined axial distance above the opening of spill passage 41 into this isolation cylinder 40**.

The isolation valve 44' in this preferred embodiment, is provided with spaced apart upper and lower lands 45' and 46', respectively, that are slidably received by the internal circular wall defining the cylinder 40. Isolation valve 44' is provided at its upper end, with reference to FIG. 4 with a reduced diameter upper portion 47' and at its lower end with a stepped blind bore **44*a*'. Intermediate the upper and lower lands 45' and 46', respectively, the isolation valve 44' is provided with a reduced diameter portion 50'**.

The reduced diameter portions 47' and 50' and the lower end of the isolation valve 44', including the internal wall defining bore **44*a*' define a variable volume pressure chamber 51' a spill chamber 52' and a variable volume drain chamber 53', respectively. As shown in FIG. 4, the spill chamber 52' is in flow communication with the drain chamber 53' by means of a radial passage 58 extending through the reduced diameter portion 50; and a downward extending axial passage 59**.

As shown in FIG. 4, the isolation valve 44' is normally biased to the position shown in that Figure by means of a coil spring 55'. This is also the position shown in FIG. 5A and is the position of the isolation valve 44' during the primary mode of operation of the injection pump 5 under the control of one or more solenoid valves 37. It is also the position of this isolation valve in the "Ignition Off" mode, that is, the position thereof when the pump is not in operation.

During operation of the secondary fuel metering control system, the fuel transfer pressure as provided by the transfer pump 17 flows through a transfer pressure orifice 68, located in control passage 43 into pressure chamber 51'. This fuel then acts on the isolation valve 44' against the bias of spring 55' to provide a speed signal whereby to modulate the injection pressure. The idle speed is governed by bleeding the spill injection pressure through the spill orifice passage **41*a***, which is appropriately sized for a particular application for the low pumping flows encountered at idle speed.

Referring now to FIGS. 5B–5E, inclusive, the various positions of the isolation valve 44' are illustrated for various modes of pump and of engine operation. Specifically, FIGS. 5B–5E show various positions of the isolation valve 44' during secondary modes of operation, that is when operation of the fuel injection pump 5 is controlled by means of the secondary fuel metering control system during a period of time when the solenoid valve 37 is functionally inoperative.

Figure 5A:
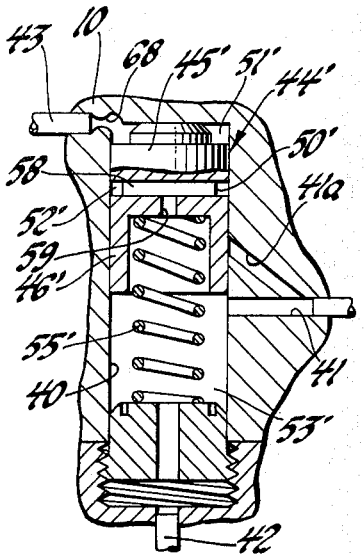
FIGS. 5A through 5E are sectional views of the isolation valve and associate portion of the pump housing, per se, of the pump of FIG. 4 showing the position of this isolation valve in the "Solenoid Mode"; "Secondary Cranking Mode"; "Secondary Idle Mode"; "Secondary Normal Driving Mode"; and, "Secondary Maximum RPM Mode", respectively.

When the pump 5 is not in operation, that is, ignition off, and when the pump 5 is operating in the "Solenoid Mode", spring 55' will bias the isolation valve 44' to the position shown in FIG. 5A. In this position of the isolation valve 44', spill passage 41 is in direct flow communication with drain chamber 53'.

It is now assumed, for the purpose of functionally describing the operation of the isolation valve 44', that the solenoid valve 37 is functionally inoperative and that fuel metering in the pump is now to be controlled by the secondary fuel metering control system.

Of course during this latter mode of pump operation, the metering valve 60 will be positioned as shown in FIG. 3 in a manner to be described in detail hereinafter. In this position of the metering valve 60 the metering groove 63 thereof is in flow communication with passage 18 and the metering slot 64 thereof will be in flow communication with the control passage 43.

Figure 5B:
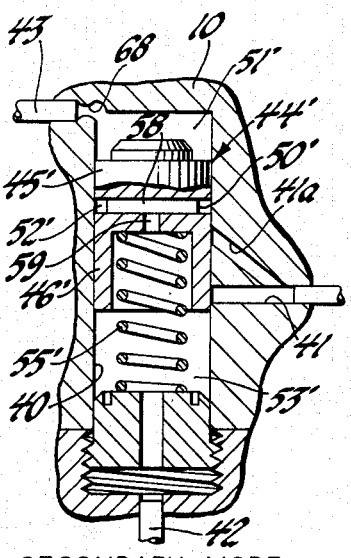

During cranking of the engine, the isolation valve 44' will be moved from the position shown in FIG. 5A to the position shown in FIG. 5B. This movement is effected by the flow of pressurized fuel at a suitable transfer pressure, as supplied by the transfer pump 17 flowing into the pressure chamber 51' to act against the bias of spring 55' to effect initial downward movement of the isolation valve 44'. As the isolation valve 44' moves downward to the position shown in FIG. 5B its land 46' is axially positioned so as to block spill flow from the spill passage 41 into drain chamber 53'. Land 46' also blocks flow from the spill orifice passage **41*a***.

Figure 5C:
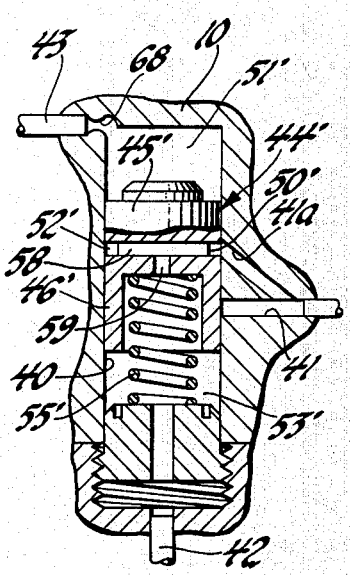
Figure 5D:
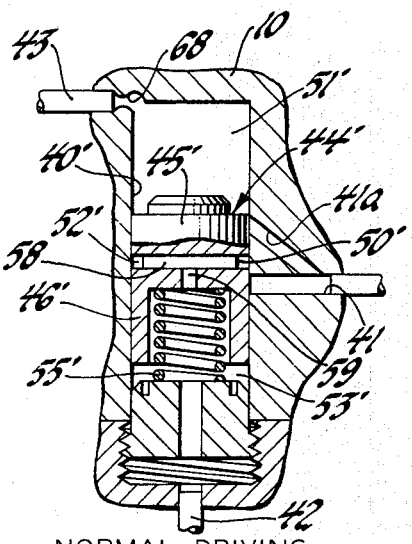

During engine operation, as the engine speed and accordingly pump speed and transfer pump 17 pressure increases, the fuel flowing into the pressure chamber 51' will then cause further downward movement of the isolation valve against the force of spring 55' until the land 46' thereof uncovers spill orifice passage **41*a*, the position of isolation valve 44' shown in FIG. 5C. Spill fuel can now flow through the spill orifice passage 41*a*, at a controlled rate depending on the flow area of this orifice passage, into the spill chamber 52' and from there into the drain chamber 53'. Thus for the same metered fuel quantity, as controlled by the annular position of the metering valve 60, less fuel is now discharged from the injector nozzle 32, since some of the fuel delivered by the pump plungers 25 from the pump chamber 24 will be spliced back to the fuel tank, and this decrease in fuel will reduce the idle speed. For this reason the spill orifice passage 41*a* may be referred to as an idle orifice. As the idle speed is reduced, the fuel transfer pressure, as provided by the transfer pump 17, will also decrease correspondingly whereby the biasing force of spring 55' can again move the isolation valve 44' back upward from the position shown in FIG. 5C to a position corresponding to that shown in FIG. 5B. In this latter position, land 46' again blocks flow through the spill orifice passage 41***a*, resulting in an increase in the amount of fuel being discharged from a fuel injection nozzle 32. The mean idle speed for a particular engine application is controlled by preselecting a particular force value for the isolation valve spring 55'.

As the metering valve 60 is opened, that is, rotated in a direction whereby the metering groove 63 is in increased flow communication with the passage 18, the larger quantity of metered fuel now being delivered to the pump chamber 24 will result in a net increase in the fuel injected and the engine speed increases accordingly. The increasing transfer pressure from the transfer pump 17 flowing into the pressure chamber 51' will then cause the isolation valve 44' to move downward from the position shown in FIG. 5C to the position shown in FIG. 5D. In this latter position of the isolation valve 44' its upper and lower lands 45' and 46' will then block flow from the spill orifice passage 41*a* and spill passage 41, respectively, so that no spill of fuel occurs and all metered fuel is discharged from the injection nozzles 32. Because of its preselected small flow capacity for a particular application, the spill orifice passage 41*a* will have little effect on the injection pressure at engine speeds above idle.

Figure 5E:
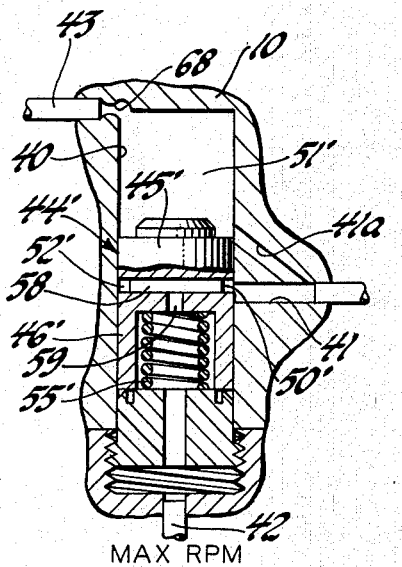

Thus the isolation valve 44' is forced downward with increasing engine speed until it bottoms out in the bottom of cylinder 40, the position shown in FIG. 5E. In this bottom out position of the isolation valve 44', the spill passage 41 will be in flow communication with the spill chamber 52', that is defined in part by the reduced diameter portion 50 between upper and lower lands 45' and 46', respectively, and the spill orifice passage 41*a* will be in flow communication with the pressure chamber 51'.

The governor frequency and the idle speed range can be predetermined, as desired, for a given engine application by proper selection of the isolation valve spring 55' rate and by proper sizing of the flow areas of the spill orifice passage 41*a* and of the supply pressure orifice 68. It will be apparent to those skilled in the art that the idle speed should preferably be set high enough to compensate for the speed response lag so as to prevent stalling during sudden engine load changes.

Referring now to FIGS. 8 through 11, inclusive, there is illustrated an exemplary embodiment of a three position, actuator means, generally designated 100, for use in effecting controlled rotative movement of the metering valve 60. As illustrated, the actuator means 100 includes an operator actuated accelerator means and a suitable electrical actuator that are operatively connected to the metering valve 60 in a manner, to be described in detail hereinafter, so as to effect selective rotative positioning of the metering valve 60 during operation of the pump 5 as controlled by the solenoid valve 37 effecting primary fuel metering or during operation of the injection pump 5 as controlled by the subject secondary fuel metering control system.

Figure 6:
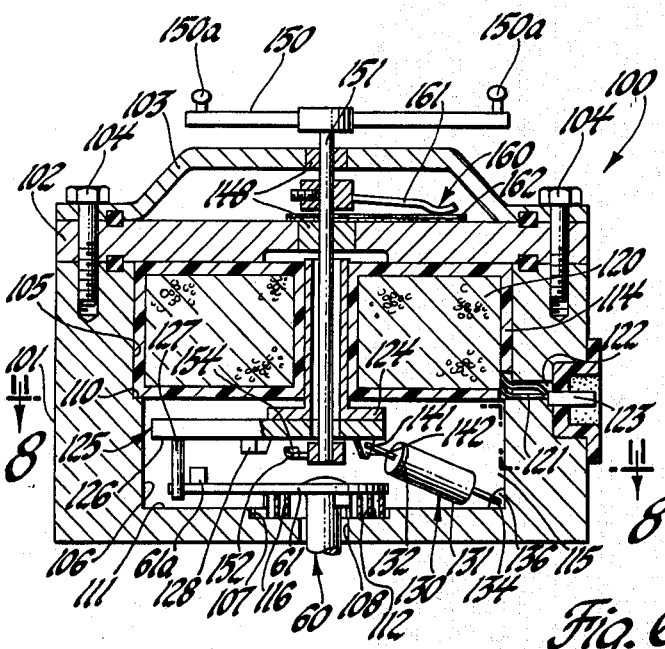
FIG. 6 is a longitudinal cross-sectional view of an embodiment of a uni-directional actuator for use in controlling the rotary movement of the metering valve of the pump of either FIGS. 1 and 3 or of FIG. 4 with parts shown in "Ignition Off" position.

In the construction illustrated, the actuator means 100 as best seen in FIG. 6 includes a multipiece housing consisting of a cup-shaped body 101, an intermediate flat body 102, and an inverted cup-shaped cover 103, these elements being suitably secured together, as by screws 104. In the embodiment shown, body 101 is provided with a stepped blind bore therethrough to define internal walls including a cylindrical upper wall 105, a cylindrical intermediate upper wall 106, a cylindrical intermediate lower wall 107 and a cylindrical lower wall 108. Walls 106, 107 and 108 are of progressively reduced internal diameters relative to the internal diameter of wall 105. Walls 105 and 106 are interconnected by a flat shoulder 110. Walls 106 and 107 are interconnected by a flat shoulder 111. Walls 107 and 108 are interconnected by a flat shoulder 112.

In the construction schematically illustrated, a conventional electrical, uni-directional rotary actuator, for example, a rotary solenoid 114 is slidably received by the upper wall 105 so that the bottom surface of the rotary solenoid 114 is supported by the flat shoulder 110. The rotary solenoid is retained against movement in the opposite direction by its abutment against the lower surface of the flat body 102. As thus positioned, the lower surface of the rotary solenoid 114 together with the wall 106 and flat shoulder 111 defines a cavity 115.

The lever 61 and the upper portion of metering valve 60 of the pump 5 are loosely received in the cavity 115, with an intermediate portion of the metering valve 60 thus being rotatably received by the internal wall 108 that is axially aligned with the metering valve chamber 20 in the hydraulic head 10. As will now be apparent, the body 101 can be formed integral with the hydraulic head 10, or as shown, it can be formed as a separate element that is adapted to be fixed to the hydraulic head 10 in a suitable known manner, not shown.

Metering valve 60 is normally biased to an angular position at which its land 60*a* blocks flow from the passage 18 by means of a metering valve spring 116 that is positioned to encircle metering valve 60. One end of the spring 116 is suitably fixed to the metering valve 60 and its opposite end is suitably fixed to the body 101, as by having bent over tab ends of the spring 116 received in suitable slots provided in the metering valve 60 and body 101, in a known manner.

The rotary solenoid 114, may be any suitable, commercially available type that is operable for an intended function in a manner to be described in detail hereinafter. Thus in the construction schematically illustrated, rotary solenoid 114 includes a solenoid coil assembly 120 that is adapted to be connected as by electrical leads 121 that extend through an aperture 122 in body 101 and are connected to a suitable electrical connector assembly 123. With this arrangement the rotary solenoid 114 can be operatively electrically connected to a conventional electronic computer so that its coil can be energized in a manner and for a purpose to be described in detail hereinafter. The hollow tubular armature 124 of the rotary solenoid 114 has a cam and pin plate 125 suitably fixed to its lower end for rotation therewith. The cam and pin plate 125 is thus positioned for pivotal movement in cavity 115 at a location axially spaced a predetermined distance above lever 61.

Figure 7:
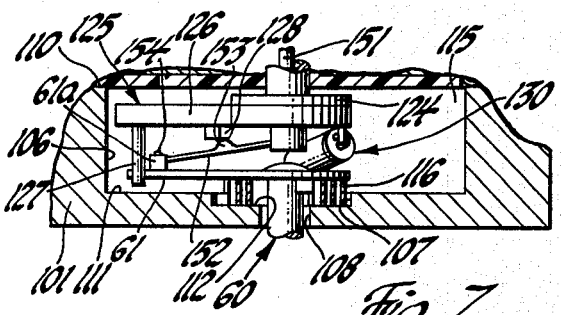
FIG. 7 is a view of the lower portion of the actuator of FIG. 6, but taken from a position to show how the spring arms thereof is deflected downward by a cam on a cam and pin plate.

As best seen in FIGS. 6 and 7, the arm 126 of the cam and pin plate 125 has a depending pin 127 fixed thereto. Pin 127 is of a suitable axial length and is located so as to extend downward for engagement against one side of the lever 61 adjacent to its outboard end whereby rotation of the armature 124 will effect corresponding movement of the lever 61 and therefore of the metering valve 60. As shown, the pin 127 is adapted to effect pivotable movement of the metering valve in a counterclockwise direction, with reference to FIG. 8, against the biasing force of the coil valve spring 116. The arm 126 of the cam and pin plate 125 is also provided with a depending double ramp cam 128 that is located radially inward of pin 127, for a purpose to be described in detail hereinafter.

Figure 8:
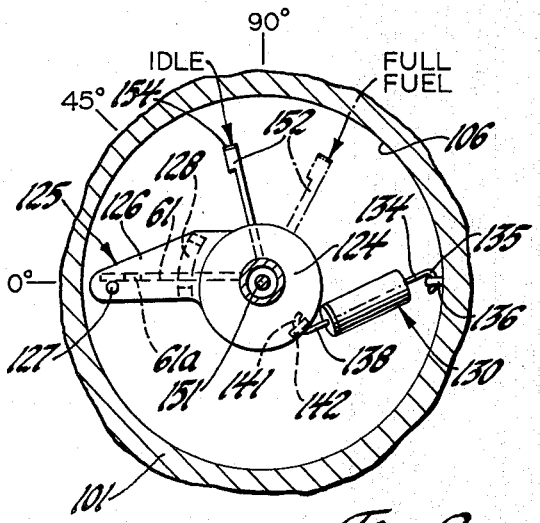

A dual rate, three-position spring means 130 is operatively fixed to the cam and pin plate 125 to normally bias it in a counterclockwise direction, with reference to FIG. 8, to an ignition-off position, the position shown in this Figure.

Figure 11:
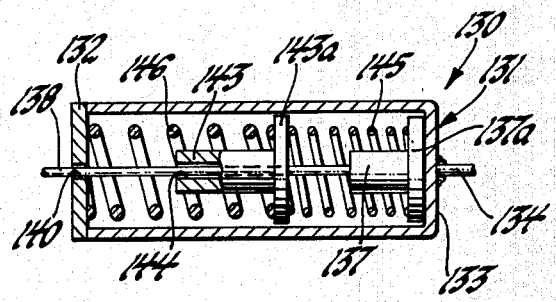

The three-position spring means 130, in the embodiment illustrated in FIG. 11, includes a hollow, tubular cup-shaped spring housing 131 with a cover plate 132 suitably fixed, as by welding, thereto so as to partly enclose the open end of the housing 131. The base 133 of housing 131 has one end of a first rod 134 suitably fixed thereto, as by welding. The opposite end of the rod 134 is provided, for example, with a bent hook portion 135 whereby the housing 131 can be connected to the body 101, as by having the bent hook portion 135 received in the apertured bracket 136 formed integral with body 101.

A first T-shaped spring retainer 137 is loosely received within the housing 131. Spring retainer 137 is provided with a second rod 138 extending axially outward from its reduced diameter end. Rod 138 is of a suitable axial extent whereby it can loosely axially extend outward through the central aperture 140 in cover plate 132. Rod 138 at its free end, is also provided, for example, with a bent hook portion 141 whereby it can be secured to the cam and pin plate 125, as by having this bent hook portion received in an apertured depending post 142 suitably fixed, as by welding, to the cam and pin plate 125.

A second T-shaped, spring retainer 143, having an axial bore 144 therethrough, is loosely received within the housing 131 in position to slidably encircle the rod 138 within the housing. A first spring 145 is positioned within the housing 131 so as to loosely encircle the rod 138 and the reduced diameter portion of the first spring retainer 137. One end of this first spring 145 is positioned in abutment against the flange portion 137*a* of the spring retainer 137 while its opposite end abuts against one side of the flange portion 143*a* second spring retainer 143. A second spring 146 is loosely positioned within the housing 131 so as to loosely encircle the reduced diameter portion of spring retainer 143. One end of the second spring 146 is positioned so as to be in abutment against the opposite side of the flange portion 143*a* of second spring retainer 143 with its opposite end in abutment against the inside surface of cover plate 132.

Figure 9:
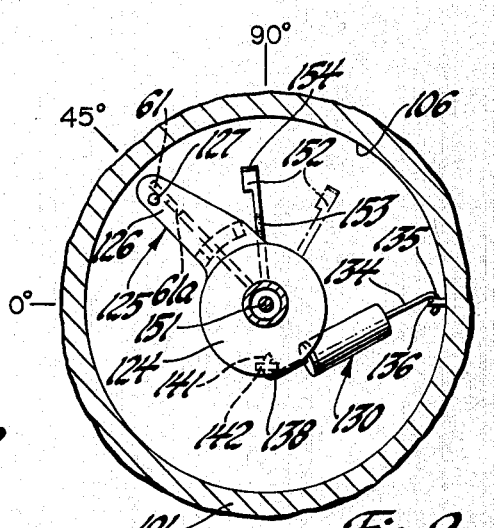
FIGS. 8, 9 and 10 are sectional views taken along a line corresponding to line 8—8 of FIG. 6 showing the relative position of various elements in the "Ignition Off"; "Solenoid Mode"; and, "Secondary Mode", respectively; and, FIG. 11 is a sectional view of the dual rate spring means, per se, of the actuator of FIG. 6.

Springs 145 and 146 are of preselected different spring rates, as desired, with the spring rate of spring 145 being less than that of spring 146 so that when an axial force of predetermined value is applied against the rod 138, so as to effect its movement to the left with reference to FIG. 11, the spring 145 will be the first spring to be compressed, as when the cam and pin plate 125 is rotated from the position shown in FIG. 8 to the position shown in FIG. 9. A greater force acting against the bias of spring 146 via rod 138 is then required to effect futher rotative movement of the cam and pin plate 125 from the position shown in FIG. 9 to the position shown in FIG. 10.

A conventional operator actuated accelerator lever 150 is fixed to one end of an accelerator shaft 151, that is, to the outboard end of this shaft as seen in FIG. 6. As shown, the accelerator shaft 151 is suitably journaled, as by bearings 148, for rotation in the cover 103 and in the flat body 102 whereby it is axially aligned so as to be loosely received through the hollow armature 124 of the rotary solenoid, and through the cam and pin plate 125 fixed thereto. As shown, the accelerator lever 150 is provided with suitable upstanding posts 150*a*, one of which is adapted to be connected in a conventional manner to an accelerator pedal, not shown, while the other is adapted to be connected to the usual accelerator return spring, not shown.

An accelerator arm 152, in the form of a wave spring, is suitably fixed at one end to the lower or inboard end of the accelerator shaft 151 for movement therewith. As shown in FIG. 6, the axial extent of the accelerator shaft 151 is such that the accelerator arm 152 is normally positiond between the cam and pin plate 125 and the lever 61. Accelerator arm 152 is provided with upstanding first and second tabs 153 and 154, respectively, located in spaced apart relationship to each other.

As best seen in FIGS. 6 and 7, the tab 153 is radially located relative to the axis of the accelerator shaft 151 so that it will be in the relative path of movement of the cam 128 on the cam and pin plate 125 while the tab 154 is radially located from the axis of rotation of the accelerator shaft 151 so as to be in the relative path of movement of cam 61*a* on the lever 61, all for a purpose to be described in detail hereinafter.

Preferably, a conventional accelerator potentiometer 160 is incorporated into the metering valve actuator mechanism 100. For this purpose, one end of an electrical potentiometer arm tap 161 is suitably fixed to the accelerator shaft 151 for rotation therewith and is suitably located axially thereon whereby its curved free end engaged an arcuate shape potentiometer resistor 162 suitably fixed to the upper flat body 102. The resistor 162 and the tap 161 are electrically connected, in a known manner, to a suitable source of electrical power and to the electronic computer, both not shown.

Since the output signal from the accelerator potentiometer is used to determine the fuel quantity to be injected during operation of the fuel injection pump as controlled by the solenoid valve 37, the operation and failure modes of the acceleration potentiometer 160 must be considered. Two potential accelerator potentiometer failure modes are, for example, loss of power to the potentiometer (zero output volts), and shorting (maximum output volts). Accordingly the accelerator potentiometer 160 should be appropriately sized for a particular engine/pump application whereby it will, in effect, be operated in the mid-region thereof so that the above-mentioned failure modes can be easily detected by suitable means, in a conventional manner not shown, whenever the voltage is substantially higher or lower than the preselected normal operating range. A broken wire or shorted potentiometer strip can thus be electrically detected, in a conventional manner, so that an electrical signal can then be supplied, as controlled by the electronic computer, to the rotary solenoid 114 to effect operation of the injection pump 5 by means of the subject secondary fuel metering control system.

As will now be apparent to those skilled in the art, a passive failure detection system should be used to detect potential failure modes of a solenoid controlled, spill-inject-spill type fuel injection pump so as to provide an electrical signal to automatically actuate the subject secondary fuel metering control system. A detailed description of such a passive failure detection system is not deemed necessary, since such systems are well known and, in effect, form no part of the subject invention. However, it should be realized that the failure sensing signals can be of two types: continuous diagnostic checks performed by the electronic computer as part of its normal program loop or monitoring of active signals such as solenoid current, start of inject signal, etc., all in a manner known in the applicable arts. These sensing signals are then used in a known manner to control the electrical current supplied to the coil 120 of the rotary solenoid.

ACTUATOR MECHANISM OPERATION

Ignition Off

When the ignition of an associate engine, both not shown, is off, the rotary actuator return spring 130 is operative to position the can and pin plate 125 to the position shown in FIG. 8. At the same time the spring 116 will normally bias the lever 61 and therefore the metering valve 60 to the position shown in FIG. 8, a position at which the land 60*a* of the metering valve blocks flow of fuel from the passage 18.

Primary Mode

When the ignition is turned on and the pump is operating in a solenoid valve 37 mode of operation, a low level electrical current is then supplied to the coil 120 of the rotary actuator, as controlled by the electronic computer. This power signal to the coil 120 is sufficient to effect rotation of the armature 124 against the bias of the weaker of the two return springs 145 and 146 of the spring means 130, that is to overcome the bias of spring 145.

The armature then rotates to a first stop, the position shown in FIG. 9, which position in the embodiment illustrated is 45° from the ignition-off position shown in FIG. 8. As the armature 124 moves to this position, the pin 127 of the associated cam and pin plate 125 effects corresponding pivotable movement of the metering valve 60 via lever 61 whereby the slot 62 on the metering valve is then aligned for flow communication with the passage 18. The metering valve 60 is thus positioned so as to permit delivery of unmetered fuel to the pump chamber 24 in the manner described hereinabove.

Secondary Mode

When the solenoid valve 37 become inoperative, as for example by reason of a short in the control circuit thereto, this failure is detected by the electronic computer, in a known manner. The electronic computer will then be operative so as to provide a high level electrical current signal to the coil 120 of the rotary solenoid 114. This high level electrical current signal to coil 120 is sufficient whereby to effect further rotation of the armature 124 against the force of the second spring 146 of the spring means 130. The cam and pin plate 125 will then be rotated to the secondary metering position, the position shown in FIG. 10, which position in the embodiment illustrated in 90° from the ignition-off position shown in FIG. 8. In this position, the lever 61 on the metering valve 60 can be engaged by the accelerator arm 152.

Secondary Fuel Metering Control

As shown in FIGS. 6, 8 and 9, the arm 61 on metering valve 60 is not engaged by the accelerator arm 152 when the accelerator lever 150 is in an idle position.

Figure 10:
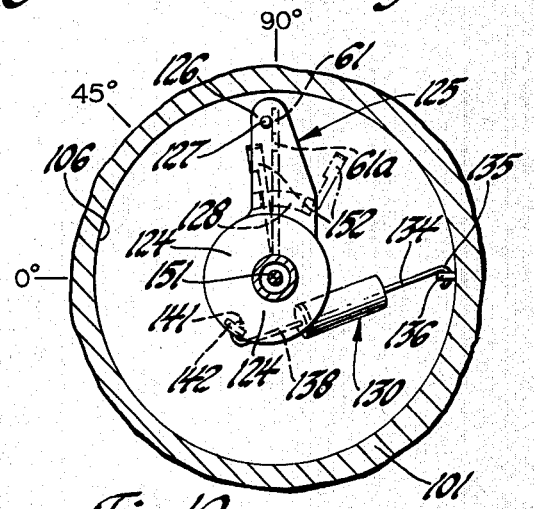

As shown, the can and pin plate 125 will move from the ignition-off position shown in FIG. 8 to the position shown in FIG. 9 when the pump 5 fuel metering is controlled by solenoid valve 27. Both of these positions are selected so as to be less than the normal rotative idle position of the accelerator arm. The range of rotative movement of the accelerator arm 152 between "idle" and "full fuel" positions are shown in FIGS. 8, 9 and 10. However, as described above, the rotary solenoid 114 operates the cam and pin plate 125 to move the metering valve 60 and its lever 61 from 0°, see FIG. 8, to slightly beyond the accelerator arm idle position at the 90° stop as shown in FIG. 10. As the cam 128 on the cam and pin plate 125 rotates above the accelerator arm, it engages the tab 153 on accelerator arm 152 to deflect the wave spring accelerator arm 152 downward whereby the tab 154 thereon first rides up the metering valve cam 61*a* and then engages it from behind tab. Thus although the accelerator arm 152 is rotationally rigid, since it is made in the form of a wave spring it is easily deflected vertically over the metering valve cam 61*a* as the two rotate past each other. To simplify the metering valve lever 61 engagement when the accelerator arm 152 is at, or returns to, the lift position following a failure, opposed cam surfaces are provided on the ends of the wave spring tab 154 and the metering valve contact cam 61*a*. Movement of the metering valve 60 is then controlled directly by operator movement of accelerator lever 150. Turning the ignition off deenergizes the rotary solenoid actuator to then allow it to be returned to the ignition-off position shown in FIG. 8 by spring means 130, whereby to pull the cam 128 out from over the accelerator arm 152. This then allows the accelerator arm to return to the position shown in FIG. 8, to then allow the metering valve to return to the ignition-off position as biased thereto by spring 116. Note that the actuator can 128 only contacts the wave spring accelerator arm 152 during the secondary mode operation. In the ignition off and solenoid mode, the accelerator arm 152 is not deflected.

Although the pumping plunger displacement cannot be limited with a solenoid controlled spill-inject-spill type pump, the low speed overfueling can be compensated by controlled leakage past the isolation valve 44' and needle valve of solenoid valve 37. Since leakage is primarily a time function and pumping rate a pump speed function, leakage will decrease with engine speed.

Fail-Soft Injection Timing Control

During fail-soft operation, injection always ends at the peak of the cam lobes of cam ring 26 and therefore, the start of injection will depend on the quantity of fuel metered. This provides some load advance with the subject secondary fuel metering control system, since pumping begins earlier on the cam with increasing fuel quantity. A small amount of speed advance will also result as leakage decreases and the pressure rise rate increases with engine speed.

While the information has been described with reference to the particular embodiments disclosed herein, it is not intended to be confined to the details set forth since it is apparent that various modifications can be made by those skilled in the art without departing from the scope of the invention.

Thus for example although a uni-directional rotary actuator 100 has been disclosed and illustrated, it will be apparent that the actuator can be constructed so as to rotate in opposite direction about a fuel shutoff position, using a fuel metering valve modified accordingly, opposite rotation being accomplished by reversing the electrical polarity to the electrical drive of the actuator. Also, for example, although the rotary actuator 100 described and illustrated has a rotary solenoid incorporated therein, it will be apparent to those skilled in the art that a conventional direct current torque motor could be used in lieu thereof.

This application is therefore intended to cover such modifications or changes as may come within the purposes of the invention as defined by the following claims.

The embodiments of the invention in which an exclusive property or privilege is claimed are defined as follows:

1. In an engine driven, solenoid valve controlled spill-inject-spill type fuel injection pump having a housing means with an injection pump means therein for sequentially supplying pressurized fuel via discharge passage means to a plurality of injectors, a spill passage means in the housing means in communication at one end with the discharge passage means and having at least one solenoid valve operatively associated therewith for normally controlling the spill-inject-spill flow from the discharge passage means, and a supply pump for supplying fuel via an inlet passage means to the injection pump means, the improvement comprising: a drain passage means connected to the spill passage means downstream of the solenoid valve, said drain passage means including a cylindeer that is connectable at one end to a reservoir for fuel at low pressure; a control passage interconnecting the inlet passage means intermediate its ends to the opposite end of said cylinder; a metering valve operatively positioned in the inlet passage means whereby to control fuel flow to the injection pump means and to said control passage; a spring biased isolation valve operatively positioned in said cylinder for controlling spill flow through the spill passage means; and an actuator means including an operator actuated accelerator lever means and an electrical actuator operatively connected to said metering valve and being operative when said solenoid valve is functionally operative to move said metering valve to a position permitting full fuel flow to the injection pump means and, when the solenoid valve is functionally inoperative to move said metering valve to positions for metering fuel flow to the injection pump means.

2. In an engine driven fuel injection pump of the type having a housing means with an injection pump means therein for sequentially supplying pressurized fuel via discharge passage means to a plurality of injectors, a spill passage means in the housing means in communication at one end with the discharge passage means and having at least one solenoid valve operatively associated therewith for normally controlling the spill-inject-spill flow from the discharge passage means, and a supply pump for supplying fuel via an inlet passage means to the injection pump means, the improvement comprising: a drain passage means including a cylinder having a drain passage extending from one end thereof that is connectable to a reservoir for fuel at low pressure, said cylinder intermediate its ends being in flow communication with the opposite end of said spill passage means; a control passage interconnecting the inlet passage means intermediate its ends to the opposite end of said cylinder; a metering valve operatively positioned in the inlet passage means at a location whereby to control fuel flow to the injection pump means and to said control passage; actuator means including an operator actuated accelerator lever means and an electrical actuator both operatively connected to said metering valve and being operative when said solenoid valve is functionally operative to permit full fuel flow to the injection pump means and, when said solenoid valve is functionally inoperative said metering valve being operative to meter fuel flow to the injection pump means and to said control passage; an isolation valve operatively positioned in said cylinder for controlling flow of fuel from said spill passage means to said drain passage; and, spring means operatively connected to said isolation valve for normally biasing it to a position permitting free flow of fuel from said spill passage means to said drain passage.

3. In an engine driven fuel injection pump of the type having a housing means with an injection pump means therein for sequentially supplying pressurized fuel via discharge passage means to a plurality of injectors, a spill passage means in the housing means in communication at one end with the discharge passage means and having at least one solenoid valve operatively associated therewith for normally controlling the spill-inject-spill flow from the discharge passage means, and a supply pump for supplying fuel via an inlet passage means to the injection pump means, the improvement comprising: a drain passage means including a cylinder having a drain passage extending from one end thereof that is connectable to a reservoir for fuel at low pressure, said cylinder intermediate its ends being in flow communication with the opposite end of said spill passage means; said spill passage means further including a spill orifice passage opening into said cylinder above said opposite end of said spill passage means; a control passage interconnecting the inlet passage means intermediate its ends to the opposite end of said cylinder; a metering valve operatively positioned in the inlet passage means at a location whereby to control fuel flow to the injection pump means and to said control passage; actuator means including an operator actuated accelerator lever means and an electrical actuator both operatively connected to said metering valve and being operative when said solenoid valve is functionally operative to permit full fuel flow to the injection pump means and, when said solenoid valve is functionally inoperative said metering valve being operative to meter fuel flow to the injection pump means and to said control passage; an isolation valve operatively positioned in said cylinder for controlling flow of fuel from said spill passage means and said spill orifice passage to said drain passage; said isolation valve having passage means, including a radial passage means extending from intermediate its ends for flow communication with said one end of said cylinder; and, spring means operatively connected to said isolation valve for normally biasing it to a position permitting free flow of fuel from said spill passage means to said drain passage while blocking flow from said spill orifice passage.

* * * * *